US005919353A

United States Patent [19]

Itou et al.

[11] Patent Number: 5,919,353

[45] **Date of Patent: *Jul. 6, 1999**

[54] METHOD FOR THERMALLY REFORMING EMULSION

[75] Inventors: Hidenobu Itou; Isao Tanaka; Manabu Katagiri, all of Ichihara; Yasuhisa Endou; Yutaka Nagita, both of Tamano, all of Japan

[73] Assignee: Mitsui Engineering & Shipbuilding Co. LTD., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/746,164

[22] Filed: Nov. 6, 1996

[30] Foreign Application Priority Data

| | | | |
|---|---|---|---|
| Nov. 10, 1995 | [JP] | Japan | 7-293007 |
| Nov. 10, 1995 | [JP] | Japan | 7-293021 |
| Nov. 10, 1995 | [JP] | Japan | 7-293022 |

[51] Int. Cl.[6] ..... C10G 33/04

[52] U.S. Cl. ..... 208/188; 208/187; 208/179; 252/346; 252/347; 252/348

[58] Field of Search ..... 208/187, 188, 208/179; 252/346, 347, 348

[56] References Cited

U.S. PATENT DOCUMENTS

| | | | |
|---|---|---|---|
| 1,715,217 | 5/1929 | Woods et al. | 208/188 |
| 3,878,090 | 4/1975 | Redford | 208/188 |
| 4,434,850 | 3/1984 | McCoy | 208/188 |
| 4,968,412 | 11/1990 | Guymon | 208/390 |
| 5,379,902 | 1/1995 | Wen et al. | 209/166 |

OTHER PUBLICATIONS abstract of "Inhibition of vanadium–induced Corrosion in Gas Turbines–by Injecting Aqueous Solution of a Magnesium Compound" (WO 8908803), Sep. 1989.

Chemical Abstracts (89:185359 CA) "Effect of Concentration of Emulsions on Emulsion Breaking", author : Maziva, 1977 no month.

Derwent (90254512) "Efficient Thick Oil Emulsion Breaking Agent". abstract, Nov. 15, 1989.

USSR (abstract) 148475 "Emulsion Breaker" no date.

*Primary Examiner*—Walter D. Griffin
*Assistant Examiner*—Nadine Preisch
*Attorney, Agent, or Firm*—Nikaido, Marmelstein, Murray & Oram LLP

[57] ABSTRACT

In a method for thermally reforming an emulsion, comprising removing water and an alkali metal or alkaline earth metal salt contained in an oil-in-water type emulsion of a tarry material or a heavy fuel oil (e.g., ORINOCO BITUMEN), sulfuric acid is added, in an amount of preferably 0.05% to 1.0% by weight based on the emulsion, to the emulsion, the mixture is allowed to stand at such a temperature as to give a difference in density between separated water and heavy fuel oil, preferably for 10 min or more, to permit oil-water separation, and the separated oil phase is withdrawn. When the tarry material is ORINOCO BITUMEN, an emulsion made of ORINOCO BITUMEN is thermochemically reformed by adding 0.1 to 0.4% by weight of sulfuric acid to ORINOCO BITUMEN, allowing the mixture to stand under pressure at a temperature of 170° to 200° C., for at least 10 min, to permit oil-water separation, subjecting the separated oil phase to flash evaporation to remove water, and centrifuging the resultant reformed ORINOCO BITUMEN to remove solid matter.

4 Claims, 13 Drawing Sheets

METHOD FOR THERMALLY REFORMING EMULSION

BACKGROUND OF THE INVENTION

The present invention relates to a method for thermally reforming a heavy fuel oil/water emulsion, and more particularly to a method for removing water, an alkali or alkaline earth metal salt and the like contained in said emulsion.

Further, the present invention relates to a method for a thermal reforming method wherein water and a magnesium component are removed from an oil-in-water type emulsion of ORINOCO BITUMEN (trademark: ORIMULSION; hereinafter referred to as "ORIMULSION"), a kind of natural asphalt, to recover a tar component.

A naturally occurring asphalt, which is an ultra-heavy fuel oil produced in the northern part of the Orinoco basin belonging to Venezuela in South America (hereinafter referred to as "ORINOCO BITUMEN"), has been confirmed to be very abundant in reserves, so that the use of ORINOCO BITUMEN in industrial applications such as fuels are expected. Since, however, ORINOCO BITUMEN is solid at room temperature (although it is transportable at 150° C. because the viscosity is lowered to 40 cSt), the handleability is poor.

For this reason, The Venezuela Petroleum Corporation has put ORINOCO BITUMEN, on the market, as an oil-in-water type emulsion (ORIMULSION) for use as a fuel for boilers. Also in Japan, more than 1,000,000 tons per year of ORIMULSION is consumed as a fuel for power generation by a boiler, and ORIMULSION is regarded as being able to compete with all other fossil fuels for both price and supply in the long term.

ORINOCO BITUMEN contains 400 to 500 ppm of vanadium which is causative of high temperature corrosion due to vanadium attack an a boiler tube during combustion in a boiler. This unfavorable phenomenon can be suppressed by the addition of a magnesium salt. For this reason, the magnesium salt is added to ORIMULSION, and ORIMULSION having a standard composition given in Table 1 is currently shipped.

TABLE 1

| Item | Analytical value | Unit | Item | Analytical value | Unit |
|---|---|---|---|---|---|
| Specific gravity | 1.01 | /15° C. | Nitrogen content | 0.4 | wt % |
| Water content | 30 | wt % | Sulfur content | 2.7 | wt % |
| Ash content | 0.3 | wt % | Mg | 500 | ppm |
| Total calorific value | 7000 | cal/g | V | 250 | ppm |
| True calorific value | 6400 | cal/g | Na | 50 | ppm |

In Table 1, the analytical values for Mg, V, and Na are those determined by elementary analysis.

ORINOCO BITUMEN have properties favorably comparable to fuel oil C and, hence, can be utilized as a fuel for a low speed diesel engine for ships, a diesel engine for power generation and the like. Properties of ORIMULSION and ORINOCO BITUMEN as a fuel age given, based on published materials, in Table 2 in comparison with properties of fuel oil C.

TABLE 2

| | ORINOCO BITUMEN | FUEL OIL C | UNIT |
|---|---|---|---|
| SPECIFIC GRAVITY | 0.976 | 0.889 | 80° C./4° C. |
| VISCOSITY | 1,528 | 34.8 | cSt/80° C. |
| NITROGEN CONTENT | 0.63 | 0.22 | % |
| SULFUR CONTENT | 3.79 | 0.97 | % |
| WATER CONTENT | <0.1 | <0.1 | % |
| CALORIFIC VALUE | About 10,000 | 10,000 | Kcal/kg |
| ASH CONTENT | 0.13 | 0.01 | % |
| RESIDUAL CARBON | 17.4 | 8.0 | % |
| V | 400~500 | Not more than 50 | ppm |
| Na | 60~100 | — | ppm |

The use of ORIMULSION as the fuel for diesel engines poses a problem that the combustion of ORINOCO BITUMEN results in precipitation of the above magnesium salt which is then incorporated into a lubricating oil, causing abrasion of a cylinder wall.

Therefore, when the use of ORINOCO BITUMEN as a fuel for diesel engines is contemplated, ORIMULSION should be reprocessed to remove the magnesium salt, added as a measure for vanadium attack, and water added for improving handleability such as in transportation.

In utilizing conventional tarry materials or heavy fuel oils, such as asphalt, coal tar pitch, and bitumen, on a commercial scale, the removal of the above contaminants in addition to the removal of impurities is necessary. For this purpose, various means have hitherto been proposed in the art.

For example, Japanese patent application Kokai publication No. 7-34072 discloses a method wherein an acidic water having pH 2.5 to 6.5 is added to a heavy fuel oil in a high shear kneading device, such as a kneader, and they are kneaded under high shear force in such a state that the heavy fuel oil strings, thereby permitting metals, oxides, nitrogen components in the heavy fuel oil to migrate into the acidic water to remove them. In this publication, there is a working example using ORIMULSION.

Japanese patent application Kokai publication No. 60-106883 discloses a method for removing a salt contained in a heavy fuel oil. In this method, water is added to a mixed oil of a high-boiling hydrocarbon oil with a light oil added thereto, and a salt-containing water is separated and removed by means of a separator (for example, electric desalting tank).

Japanese patent application Kokai publication No. 55-12200 discloses a method wherein a heavy residual oil, asphaltene tar or the like is purified by extraction with a solvent, such as butyl alcohol/ketone, to promote phase separation, thereby promoting the removal of impurities.

Japanese patent publication No. 56-54036 discloses a method wherein a demulsifying agent is added to a salt-containing tar absorption oil produced in the step of purifying a coke oven gas, and the mixture is separated into an oil phase and a water phase containing a water-soluble salt, permitting the salt to be separated and removed from the absorption oil in a continuous and efficient manner.

In the methods disclosed in the above publications, however, water and an alkali metal or alkaline earth metal contained in an ultra-heavy fuel oil cannot be efficiently removed, and the agents added render these methods cost-ineffective, necessitating the establishment of a more effective removal method. In particular, the application of the above methods to ORIMULSION results in large power consumption for the operation of the kneader and the difficulty of handling a high viscosity tar. Thus, for the conventional methods, there is still room for improvement.

SUMMARY OF THE INVENTION

An object of the present invention is to provide a method, for thermally reforming an emulsion, which can remove an alkali metal and an alkaline earth metal contained in an oil-in-water type emulsion of a heavy fuel oil, including an ultra-heavy fuel oil, such as ORINOCO BITUMEN, or a tarry material.

In order to attain the above object, according to one aspect of the present invention, there is provided a method for thermally reforming an emulsion, comprising removing water and an alkali metal or alkaline earth metal salt contained in an oil-in-water type emulsion of a tarry material or a heavy fuel oil, wherein sulfuric acid is added to the emulsion, the mixture is allowed to stand at such a temperature as to give a difference in density between separated water and heavy fuel oil of not less than 0.005, preferably not less than 0.007, under saturated vapor pressure in said temperature to permit oil-water separation, and the separated oil phase is withdrawn.

Said tarry materials or heavy fuel oils include fuel oil C, asphalt, ORINOCO BITUMEN, tar sand, etc. There is no particular limitation on means for bringing the tarry material to an oil-in-water type emulsion, and any conventional means may be used.

Said sulfuric acid is not particularly limited. However, the use of commercially available 98% concentrated sulfuric acid is preferred from the viewpoint of economy.

Magnesium intentionally added to ORIMULSION is also embraced in the alkali metal and alkaline earth metal to be removed by the method of the present invention.

Upon oil-water separation, the oil phase is in a water-in-oil type emulsion. For ORINOCO BITUMEN, the relationship between the density of the oil and water phases and the temperature is as shown in FIG. 1. Specifically, for reformed ORINOCO BITUMEN, separated water, and water in terms of a vapor pressure of 6.5 atm, the relationship between the density and the temperature is such that the density of the separated water is, at about 100° C., about 0.007 higher than that of the reformed ORINOCO BITUMEN, is, at about 140° C., equivalent to that of the reformed ORINOCO BITUMEN, and, at higher temperatures, is lower than that of the reformed ORINOCO BITUMEN, that is, is, at 180° C., 0.012 lower than that of the reformed ORINOCO BITUMEN and is, at 200° C., 0.013 lower than that of the reformed ORINOCO BITUMEN.

In the above temperature range, the pressure is in the range of from atmospheric pressure to 15 atm, requiring for all devices for maintaining the temperature to be high-pressure vessels.

In oil-water separation under high temperature and high pressure conditions, when the system is allowed to stand for a given period of time, for example, 10 min or more, it is separated into two distinct phases, enabling the separation and recovery of an oil phase, as a heavy-gravity component, of the reformed tar and a water phase, as a light-gravity component, with the above metal salt dissolved therein. The above standing time is one in the case where a satisfactorily homogeneous temperature profile is provided in the emulsion. If the temperature profile is slightly heterogeneous, or if the oil phase is circulated by convection, the standing time should be longer, for example, one hr or longer.

The removal of water and an alkali metal or an alkaline earth metal from the emulsion according to the present invention is influenced mainly by the amount of sulfuric acid added, the heating temperature, and the holding time. Under conditions which give a density difference of not less than 0.005, preferably not less than 0.007, still preferably not less than 0.01, in the case of, for example, tar, the water concentration can be brought to not more than 1% by weight with the Mg concentration being brought to not more than 100 ppm.

The amount of sulfuric acid added, heating and standing temperatures, and standing time vary depending upon tarry materials to be treated. In general, however, the amount of sulfuric acid added is 0.05 to 1.0% by weight based on the emulsion, the standing time is not less than 10 min in the case of absence of any flow, such as convection, in the oil phase, and, in the presence of current velocity profile, should be longer, for example, one hr, and the temperature is such as to give the above density difference.

For example, in the case of ORIMULSION having a magnesium content of 500 ppm (corresponding to 620 ppm in terms of ORINOCO BITUMEN), the addition of sulfuric acid in an amount of not less than 0.1% by weight (corresponding to theoretical amount relative to Mg) to the ORIMULSION can lower the water concentration of the reformed tar to not more than 1.5% by weight, the addition of sulfuric acid in an amount of about 0.2% by weight can lower the water concentration of the reformed tar to not more than 1% by weight, and the addition of sulfuric acid in an amount of about 0.4% by weight can lower the water concentration of the reformed tar to not more than 0.75% by weight.

On the other hand, regarding the Mg concentration, so far as other conditions are met, the addition of sulfuric acid in an amount of not less than 0.1% by weight (corresponding to theoretical amount relative to Mg) to the ORIMULSION can lower the Mg concentration of the reformed tar to not more than 300 ppm, the addition of sulfuric acid in an amount of about 0.2% by weight can lower the Mg concentration of the reformed tar to not more than 130 ppm, and the addition of sulfuric acid in an amount of about 0.4% by weight can lower the Mg concentration of the reformed tar to not more than 100 ppm.

Regarding the temperature conditions, so far as other conditions are met, a temperature of about 170° C. or above suffices for significantly removing Mg, and, in the case of a temperature of 180° C. or above, the Mg concentration can be brought to not more than 100 ppm. The standing time may be at least 10 min.

For ORIMULSION, the addition of sulfuric acid in an amount of 0.4% by weight results in substantially saturated lowering of the Mg and water concentrations, and the addition of sulfuric acid in a larger amount is unfavorable because it leads to an increase in cost of post treatment such as neutralization of recovered water. When the flow of the separated oil phase is satisfactorily prevented, a standing time of not less than 10 min, preferably not less than 30 min offers substantially fixed water-oil separation. Therefore, standing for a longer period of time results in increased capacity of the separation column and increased cost for maintaining the temperature and, hence, is cost-ineffective.

The oil phase separated after the thermal reforming contains a very small amount of water droplets, and rapid release into the air can effectively remove the water. Solid matter unavoidably mixed in the reformed tar can be removed by a centrifuge provided in a diesel engine.

In order to solve the above problems, according to the second aspect of the present invention, there is provided a method for thermochemically reforming an emulsion, comprising removing water and an alkali metal or alkaline earth metal salt contained in an oil-in-water type emulsion of a tarry material or a heavy fuel oil, wherein 0.1 to 1.0% by weight of sulfuric acid is added to the emulsion, the mixture is allowed to stand at a temperature of 170° to 220° C. for 10 min or more to permit oil-water separation, and the separated oil phase is withdrawn.

In the above temperature range, the pressure is approximately in the range of from 13 to 15 atm, requiring for all devices for maintaining the temperature to be high-pressure vessels. In oil-water separation under high temperature and high pressure conditions, when the system is allowed to stand for a given period of time, for example, 10 min or more, it is separated into two distinct phases from which the withdrawal of the water phase with the above the alkali metal and alkaline earth metal dissolved therein can easily offer the separation of the salt of the above metal from the reformed tarry material or heavy fuel oil.

The oil phased separated after the thermochemical reforming contains a very small amount of water droplets, and rapid release into the air can effectively remove the water.

Further, in order to solve the above problems, according to the present invention, there is provided a method for thermochemically reforming particularly ORIMULSION, comprising the steps of: adding 0.1 to 0.4% by weight of sulfuric acid to an oil-in-water type emulsion; allowing the mixture to stand under pressure at a temperature of 170° to 200° C. for at least 10 min to permit oil-water separation; subjecting the separated oil phase to flash evaporation to remove a very small amount of water present in the reformed tar; and centrifuging the resultant reformed ORINOCO BITUMEN to remove solid matter.

A percentage removal of water of 95 to 99% can be achieved under conditions which give a high percentage removal of Mg.

The addition of sulfuric acid in an amount of 0.4% by weight results in substantial saturation of the above percentage removal, and the addition of sulfuric acid in a larger amount is unfavorable because it leads to an increase in cost of post treatment such as neutralization of recovered water. When the flow of the separated oil phase is satisfactorily prevented, a standing time of about 30 min offers substantially fixed water-oil separation. Therefore, standing for a longer period of time results in increased cost for maintaining the temperature and, hence, is cost-ineffective.

Upon oil-water separation, the oil phase (hereinafter referred to as "reformed tar") is in a water-in-oil type emulsion, and for the reformed tar, separated water, and water in terms of a vapor pressure of 17 atm, the relationship between the density and the temperature is as shown in FIG. 1. As can be understood from FIG. 1, the relationship between the density and the temperature is such that the density of the reformed tar is, at about 100° C., about 0.007 higher than that of the separated water, is, at 180° C., 0.012 higher than that of the separated water and is, at 200° C., 0.013 higher than that of the separated water. In oil-water separation under high temperature and high pressure conditions, when the system is allowed to stand for 10 min or more, it is separated into two distinct phases, permitting the reformed tar to be recovered.

The oil phase after the oil-water separation is in the form of a water-in-oil type emulsion, and flash evaporation of the oil phase under high temperature and high pressure conditions results in removal of a very small amount of water present in the reformed tar.

As is apparent from the foregoing description, in the method for thermally reforming an emulsion according to the present invention, the addition and mixing of sulfuric acid with an oil-in-water type emulsion of a tarry material or a heavy fuel oil followed by standing under high temperature and high pressure conditions, for a given period of time, to conduct oil-water separation enables water and an alkali metal or an alkaline earth metal to be efficiently removed. Therefore, the reformed oil can be advantageously used as a fuel for diesel engines or the like.

Further, according to the method for thermochemically reforming ORIMULSION which comprises adding and mixing sulfuric acid with ORIMULSION, allowing the mixture to stand for a given period of time under high temperature and high pressure conditions to conduct oil-water separation, reducing the pressure of the separated reformed tar to the atmospheric pressure under high temperature to evaporate a very small amount of water present in the reformed tar, and centrifuging the reformed tar to remove solid matter, water and magnesium contained in ORIMULSION can be removed with a high percentage removal. Therefore, ORINOCO BITUMEN can be made usable as a fuel for diesel engines.

DETAILED DESCRIPTION OF THE PREFERRED EMBODIMENT

EXAMPLE 1

Figure 1:
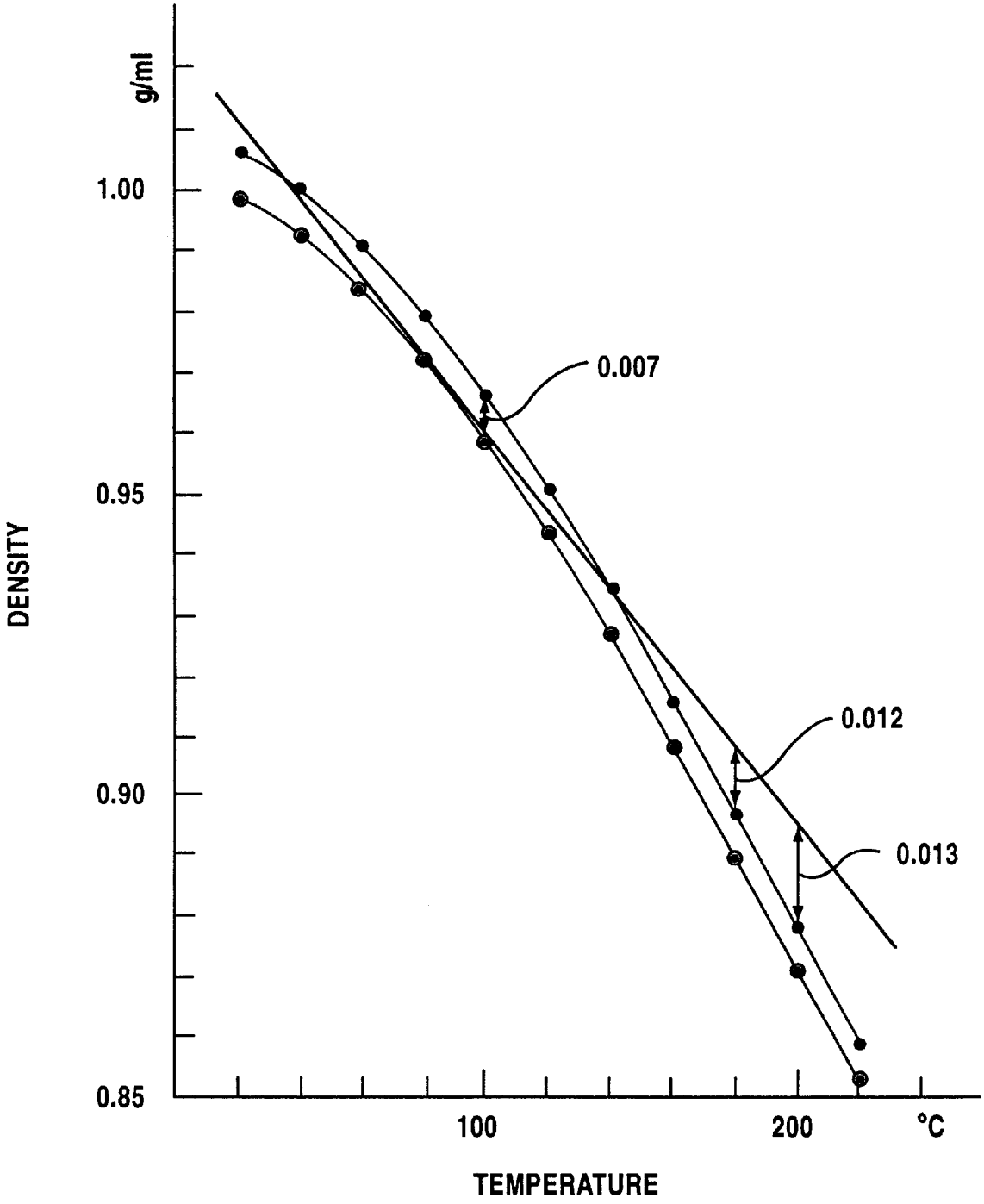
FIG. 1 is a graph showing the relationship between the temperature and the oil phase and water phase densities in the thermal reforming of emulsion with sulfuric acid and oil-water separation.
Figure 2:
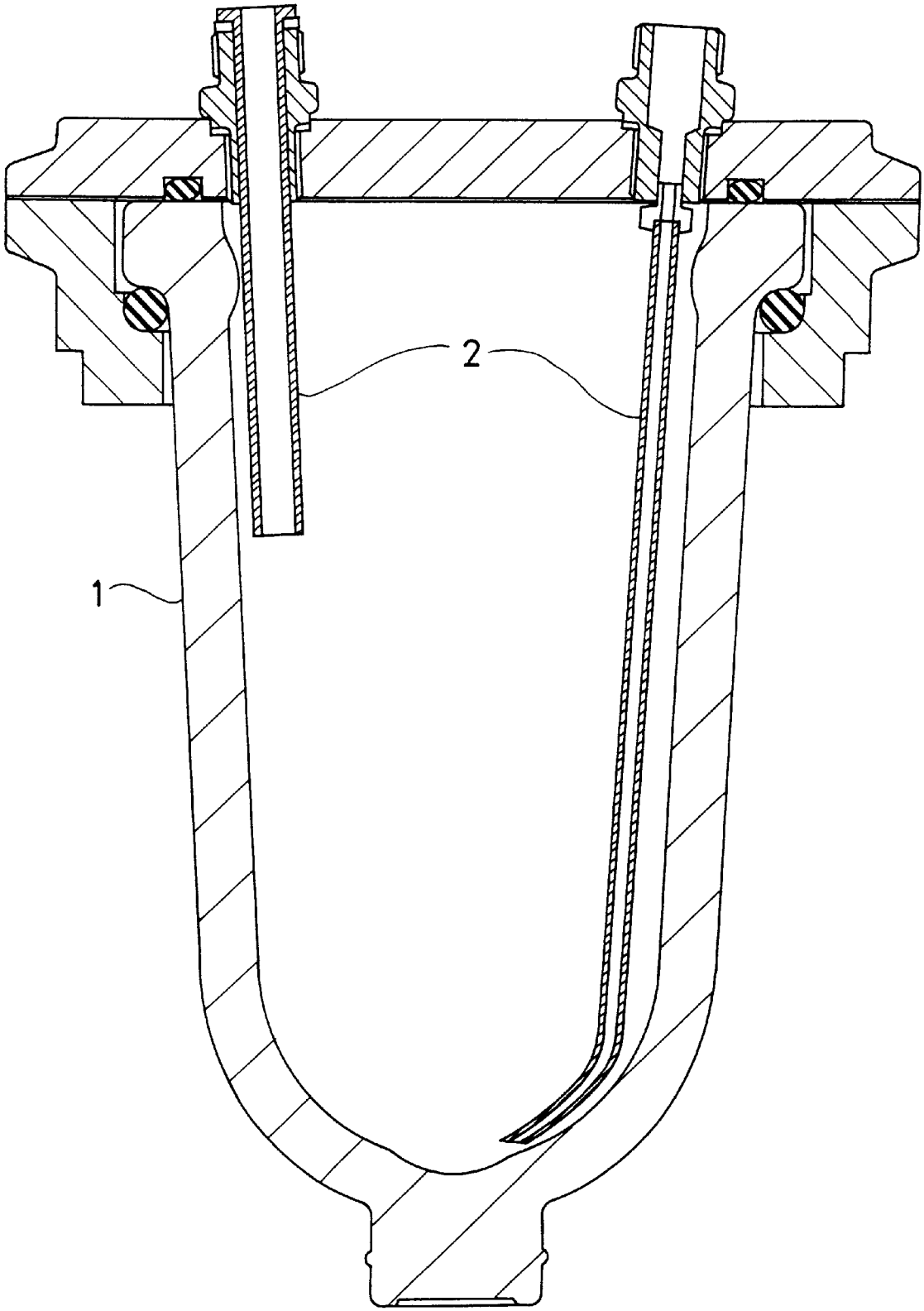
FIG. 2 is a cross-sectional view of a stationary oil-water separator used in a batch treatment in the first embodiment of the present invention.

Example 1 of the present invention which was carried out batch-wise will be described. Sulfuric acid was added in an amount specified in Table 3 to 800 ml of ORIMULSION, and they were homogeneously mixed together by means of an agitator at 500 rpm, placed in a pressure vessel 1 shown in FIG. 2, heated at a temperature rise rate of 4.5° C./min, allowed to stand under temperature and time conditions specified in Table 3, sampled through a sampling tube 2 after the elapse of the predetermined time. For the samples, the results were evaluated.

amount of about 0.2% by weight to ORIMULSION can lower the Mg concentration of the reformed tar to not more than 130 ppm, and the addition of sulfuric acid in an amount of 0.4% by weight to ORIMULSION can lower the Mg concentration of the reformed tar to not more than 100 ppm.

Figure 3A:
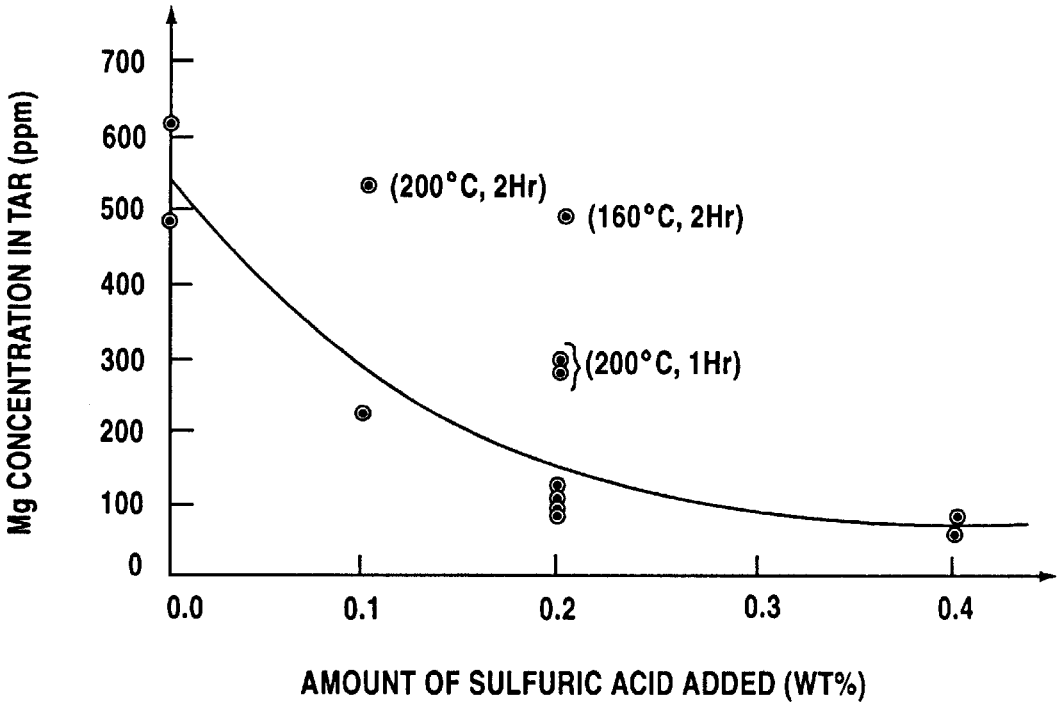
FIG. 3A is a graph showing the relationship, in terms of concentration, between the amount of sulfuric acid added and Mg remaining in the reformed tarry material, based on the results of the first embodiment of the present invention.
Figure 3B:
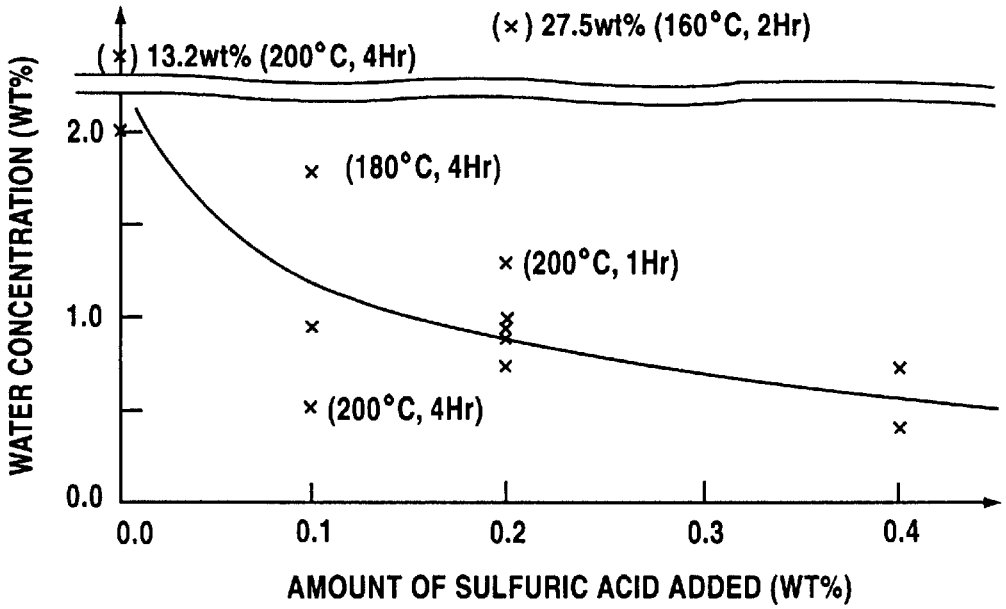
FIG. 3B is a graph showing the relationship between the amount of sulfuric acid added and the concentration of water remaining in the reformed tarry material, based on the results of the first embodiment of the present invention.

On the other hand, as is apparent from FIG. 3B, the addition of sulfuric acid in an amount of not less than 0.1% by weight to ORIMULSION can lower the water concentration of the reformed tar to not more than 1.00% by weight, the addition of sulfuric acid in an amount of 0.2% by weight to ORIMULSION can lower the water concentration of the reformed tar to not more than 1% by weight, and the addition of sulfuric acid in an amount of 0.4% by weight to ORIMULSION can lower the water concentration of the reformed tar to not more than 0.75% by weight.

Figure 3C:
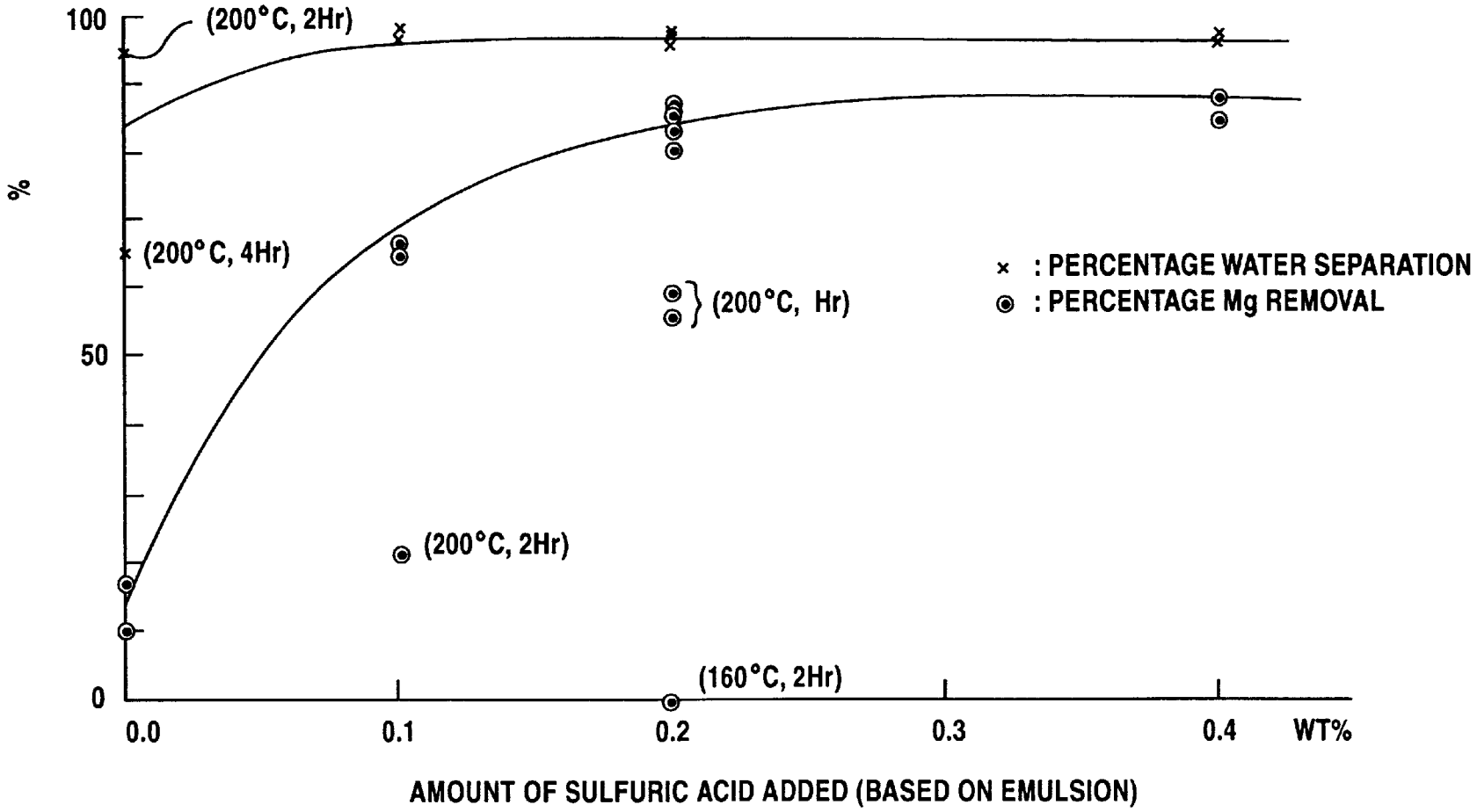
FIG. 3C is a graph showing the relationship, in terms of percentage separation, between the amount of sulfuric acid added and the concentrations of Mg and water remaining in the reformed tarry material, based on the results of the first embodiment of the present invention.

As shown in FIG. 3C, the percentage removal of Mg and the percentage separation of water reaches the maximum when the amount of sulfuric acid added is around more than 0.2% by weight.

Figure 4A:
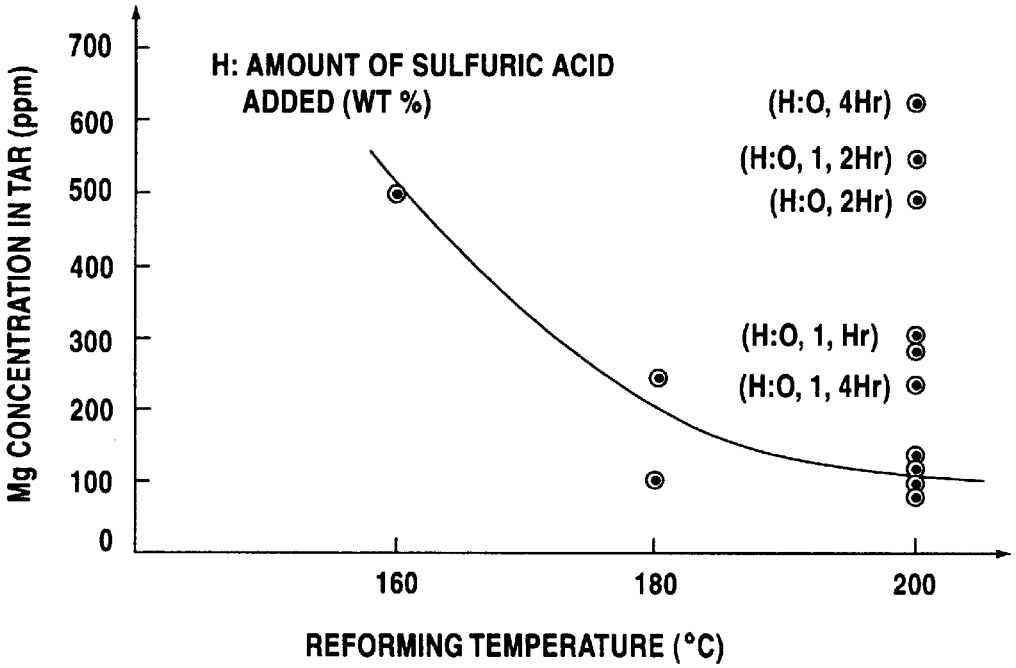
FIG. 4A is a graph showing the relationship, in terms of concentration, between the thermal reforming temperature and Mg remaining in the reformed tarry material, based on the results of the first embodiment of the present invention.
Figure 4B:
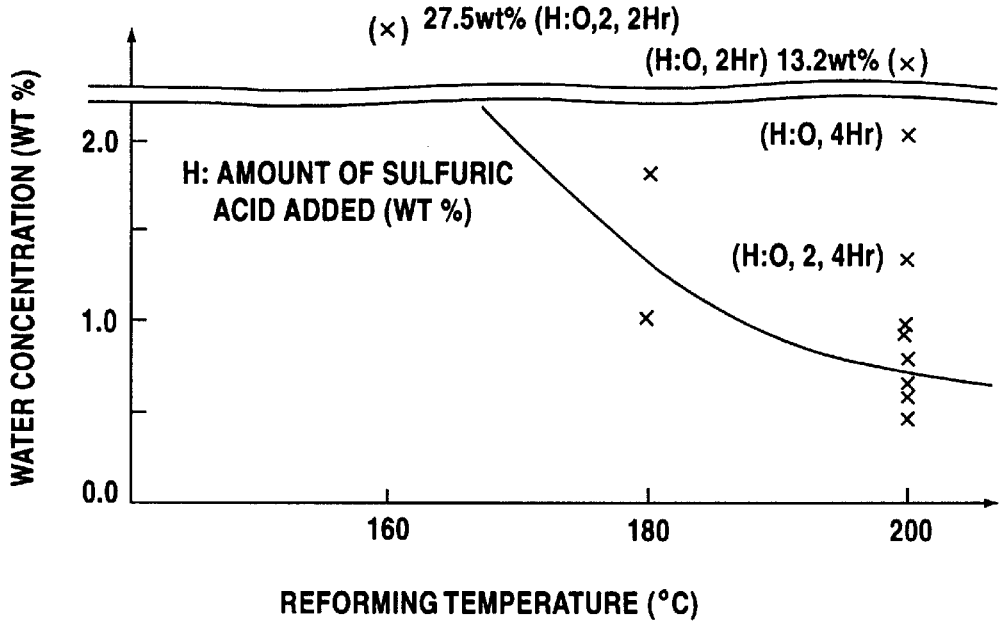
FIG. 4B is a graph showing the relationship between the thermal reforming temperature and the concentration of water remaining in the reformed tarry material, based on the results of the first embodiment of the present invention.
Figure 4C:
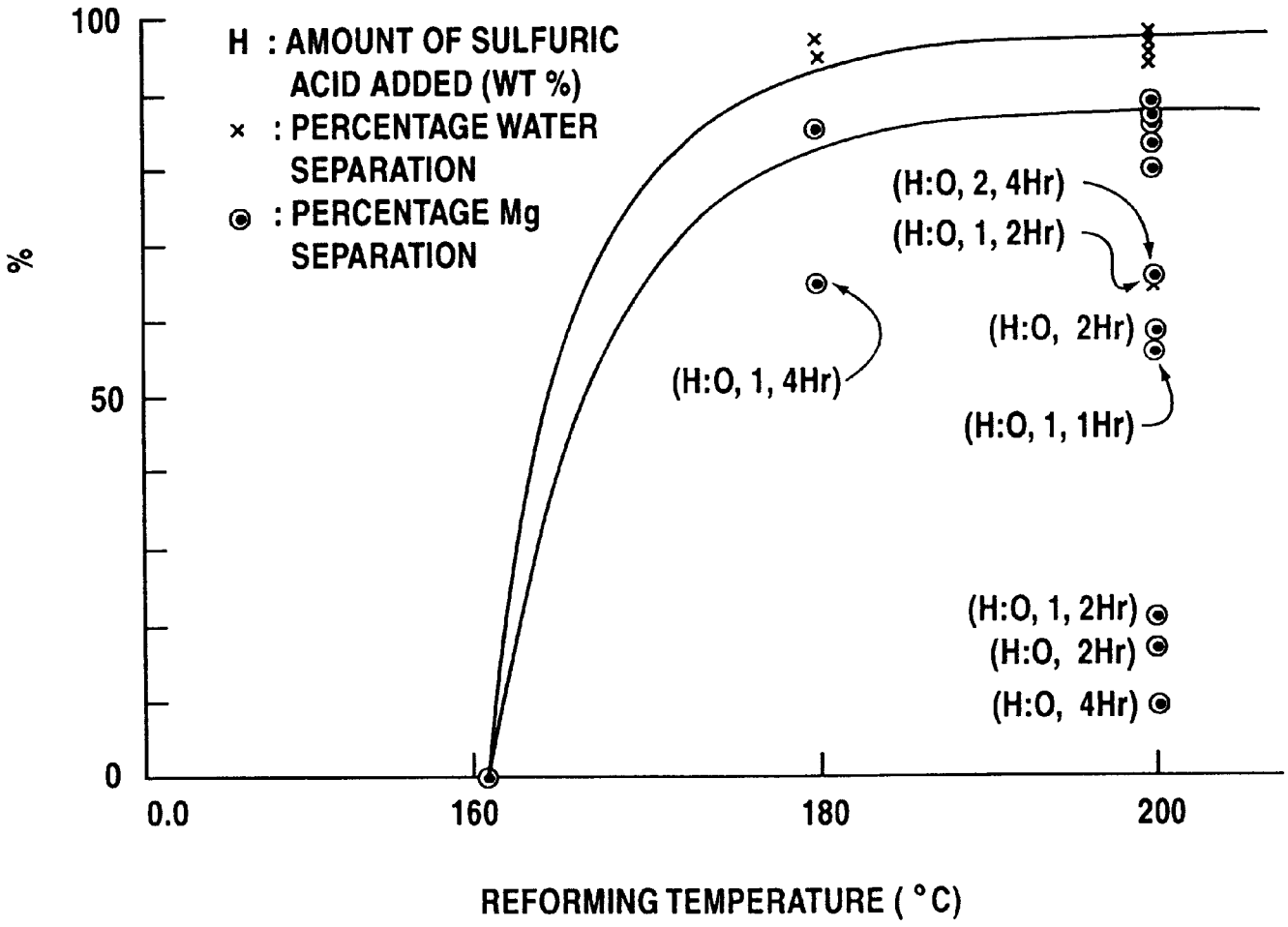
FIG. 4C is a graph showing the relationship, in terms of percentage separation, between the thermal reforming temperature and the concentrations of Mg and water remaining in the reformed tarry material, based on the results of the first embodiment of the present invention.

Regarding temperature conditions, as shown in FIGS. 4A and 4C, a temperature of about 170° C. suffices for significantly removing Mg, and the Mg concentration can be lowered to around 200 ppm at a temperature of 180° C. and to around 100 ppm at a temperature of 200° C.

On the other hand, as shown in FIG. 4B, the water concentration can be lowered to 1 to 2% by weight at a temperature of 180° C. and to not more than 1% by weight at 200° C. As can be understood from FIG. 4C, reforming at 200° C. results in substantial saturation of the percentage removal.

Figure 5A:
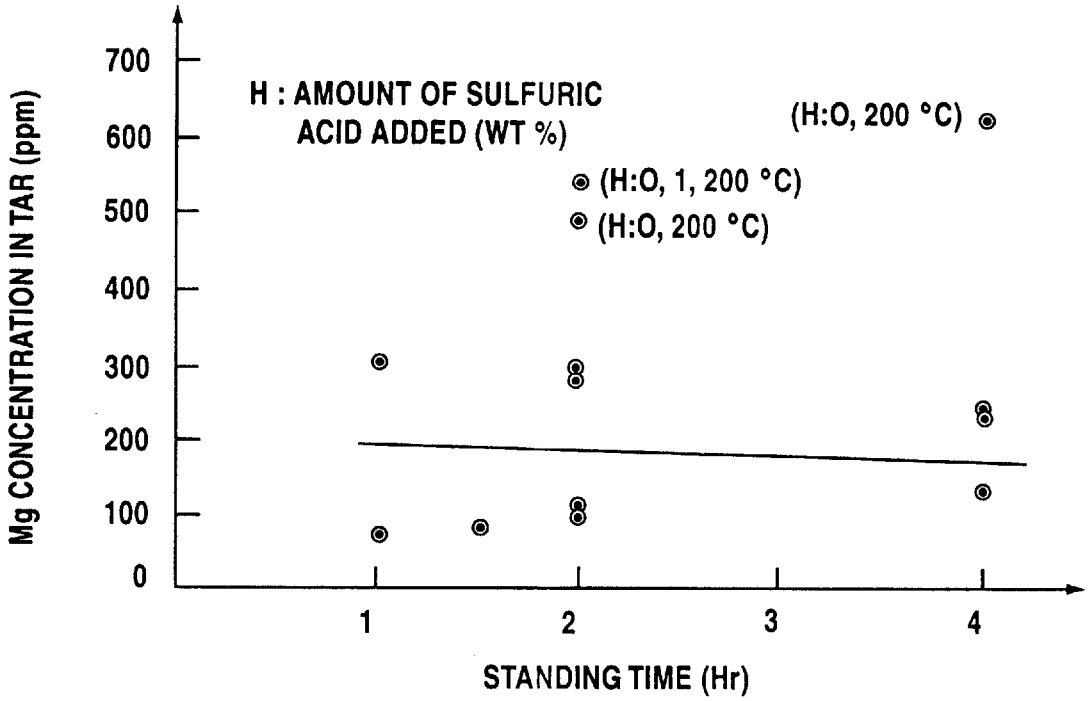
FIG. 5A is a graph showing the relationship, in terms of concentration, between the standing time and Mg remaining in the reformed tarry material, based on the results of the first embodiment of the present invention.
Figure 5B:
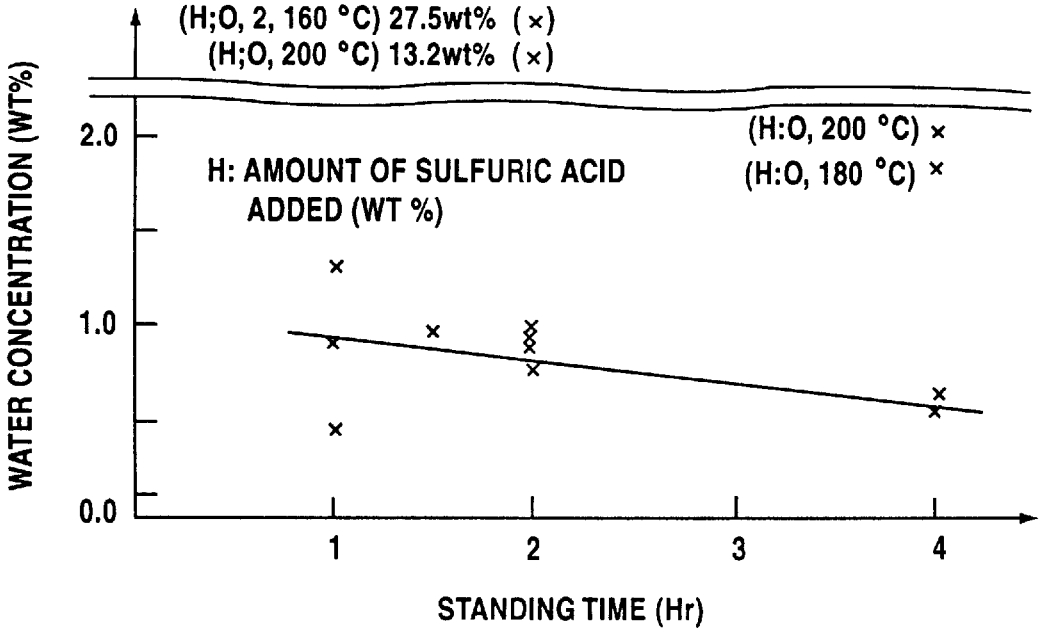
FIG. 5B is a graph showing the relationship between the standing time and the concentration of water remaining in the reformed tarry material, based an the results of the first embodiment of the present invention.
Figure 5C:
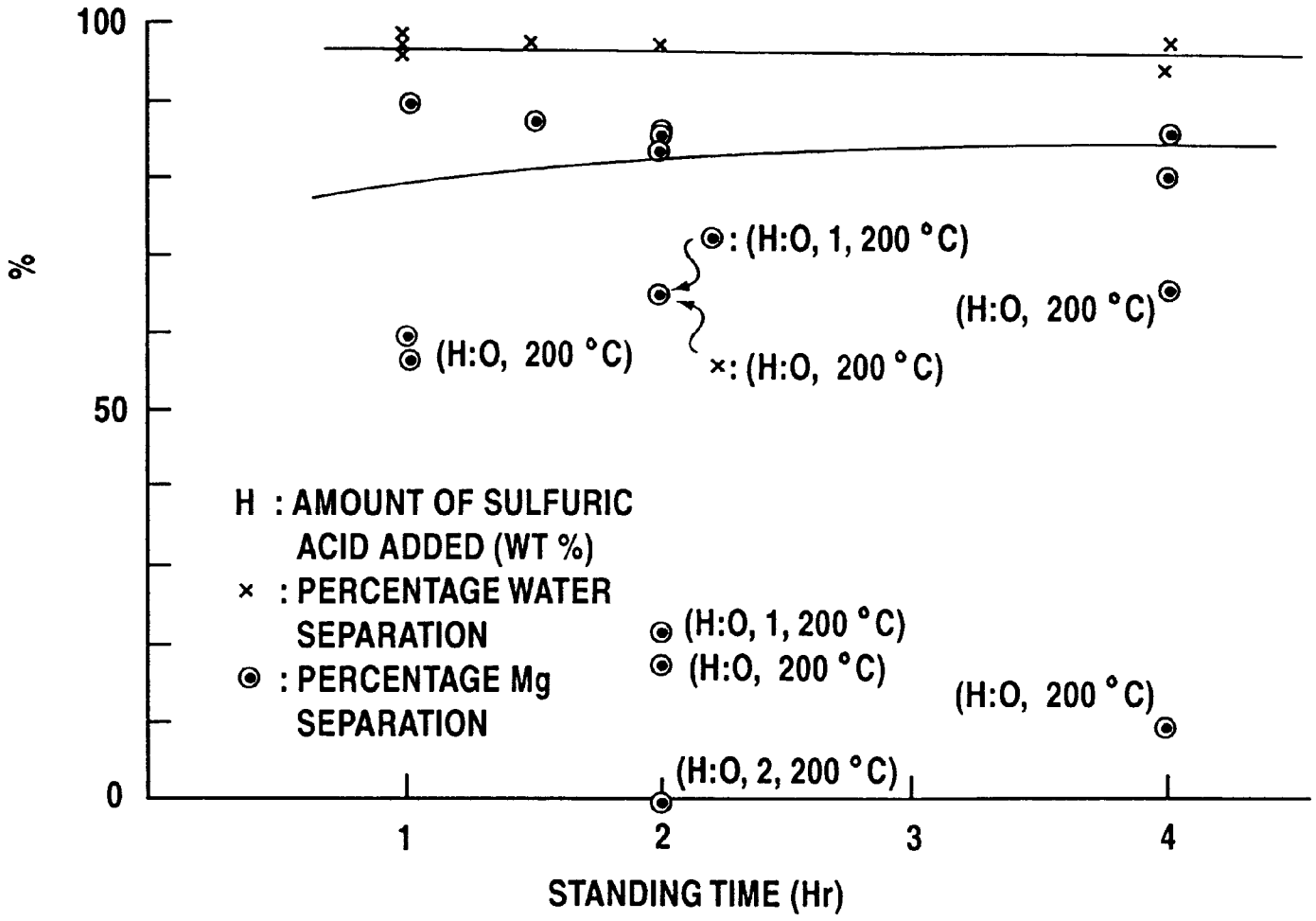
FIG. 5C is a graph showing the relationship, in term of percentage separation, between the standing time and the concentrations of Mg and water remaining in the reformed tarry material, based on the results of the first embodiment of the present invention.

Regarding the standing time, as shown in FIGS. 5A to 5C, standing for one hr offers oil-water separation. Based on these data, a continuous reforming apparatus can be designed.

From the above results, it is apparent that, in the case of a batch treatment, reforming under conditions of the addition of sulfuric acid in an amount of not less than 0.1% by

TABLE 3

| No | Heating temp. ° C. | Standing temp. ° C. | Standing time hr | Amount of sulfuric acid added wt % | Charge L | Mg concentration of tar ppm | Water concentration of tar wt % | Removal of Mg wt % | Dehydration % |
|---|---|---|---|---|---|---|---|---|---|
| Raw material | | | | | | 500 | 27.50 | | |
| 1 | 200 | 200 | 1.0 | 0.20 | 0.8 | 280 | 0.95 | 59.4 | 97.5 |
| 2 | 200 | 200 | 1.0 | 0.20 | 0.8 | 300 | 1.30 | 56.5 | 96.6 |
| 3 | 200 | 200 | 1.0 | 0.40 | 0.8 | 72 | 0.42 | 89.6 | 98.9 |
| 4 | 200 | 200 | 1.5 | 0.20 | 0.8 | 85 | 0.88 | 87.7 | 97.7 |
| 5 | 200 | 200 | 2.0 | 0.10 | 0.8 | 540 | 0.95 | 21.7 | 97.5 |
| 6 | 200 | 200 | 2.0 | 0.20 | 0.8 | 110 | 0.90 | 84.1 | 97.6 |
| 7 | 200 | 200 | 2.0 | 0.40 | 0.8 | 93 | 0.75 | 86.5 | 98.0 |
| 8 | 200 | 200 | 2.0 | None | 0.75 | 490 | 13.20 | 17.4 | 65.2 |
| 9 | 200 | 200 | 4.0 | 0.20 | 0.8 | 130 | 0.63 | 81.2 | 98.3 |
| 10 | 200 | 200 | 4.0 | 0.20 | 0.8 | 92 | 0.62 | 86.7 | 98.4 |
| 11 | 200 | 200 | 4.0 | 0.40 | 0.8 | 230 | 0.52 | 66.7 | 98.6 |
| 12 | 200 | 200 | 4.0 | None | 0.8 | 620 | 2.00 | 10.1 | 94.7 |
| 13 | 180 | 180 | 2.0 | 0.20 | 0.8 | 98 | 1.00 | 85.8 | 97.4 |
| 14 | 180 | 180 | 4.0 | 0.10 | 0.8 | 240 | 1.80 | 65.2 | 95.3 |
| 15 | 160 | 160 | 2.0 | 0.20 | 0.8 | 500 | 27.50 | | Unseparable |

The relationship, between the amount of sulfuric acid added and the water and Mg concentrations of the reformed tar, determined based on data given in Table 3 is shown in FIG. 3.

As is apparent from FIG. 3A, the addition of sulfuric acid in an amount of not less than 0.1% by weight to ORIMULSION can lower the Mg concentration of the reformed tar to not more than 300 ppm, the addition of sulfuric acid in an weight, preferably not less than 0.2% by weight, still preferably around 0.4% by weight, based on the ORIMULSION, a temperature of 170° C. or above, preferably around 200° C., and a standing time (reaction and oil-water separation time) of not less than 1 hr can lower the Mg concentration to not more than 100 ppm, preferably about 50 ppm, with the percentage removal of Mg being not less than 80% or, in the case of use of all the above preferred conditions, around 90%. Further, it is apparent that the water content can be lowered to not more than 1% by weight, preferably around 0.5% by weight.

EXAMPLE 2

Example 2 which was carried out using the pressure vessel 1 employed in Example 1 will be described. 800 ml of ORIMULSION was placed in the pressure vessel 1, homogeneously mixed by means of an agitator at 500 rpm, heated at a rate of 4.5° C./min, allowed to stand at a temperature of 160° to 200° C. for a predetermined period of time (a settling time), sampled after the elapse of a predetermined time through the sampling tube 2 of the vessel, and, for the samples, the percentage removal of Mg in the tar phase was determined. The results are shown in FIG. 6.

Figure 6:
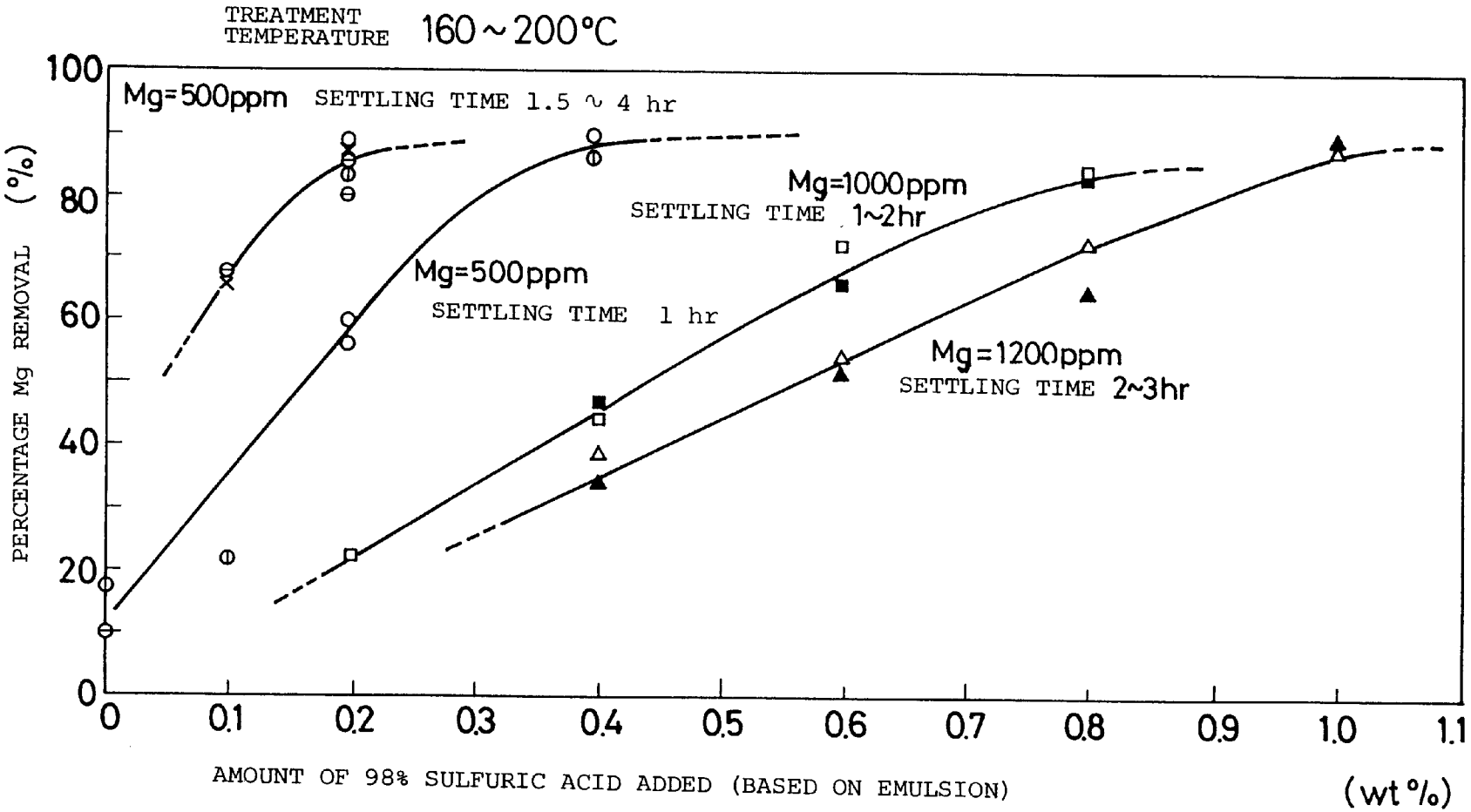
FIG. 6 is a graph showing the relationship between the amount of sulfuric acid added and the concentrations of Mg and water remaining in the reformed tarry material, based on the results of the second embodiment of the present invention.

In FIG. 6, the results for each Mg content of ORIMULSION are shown in a graph wherein the abscissa represents the amount of sulfuric acid added. The settling time was described for each curve. From the results, it is apparent that the percentage removal of Mg improves with increasing the amount of sulfuric acid added and a percentage removal of Mg around 90% can be obtained for all the Mg contents of ORIMULSION.

EXAMPLE 3

Figure 7:
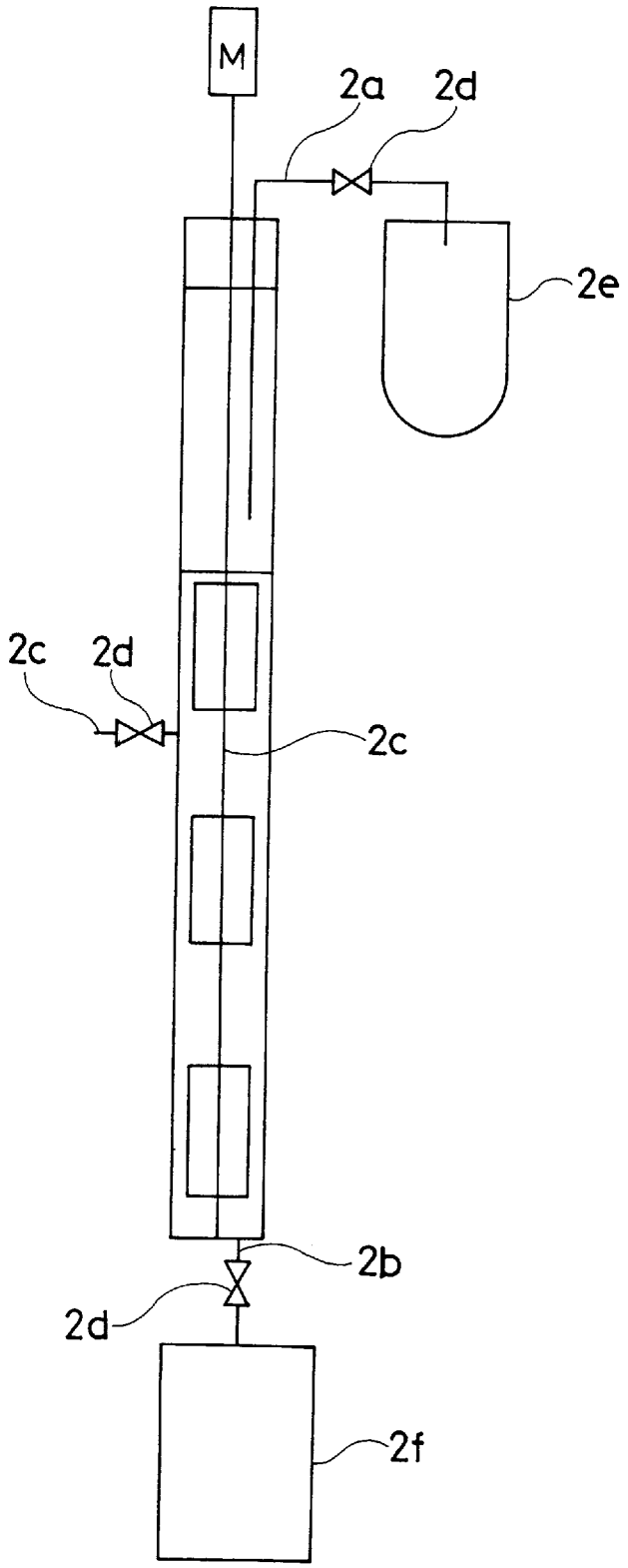
FIG. 7 is a schematic explanatory view of a pressure vessel used in Example 3.

In Example 3, a pressure vessel shown in FIG. 7 was used. The pressure vessel 1 was an iron pipe (capacity: 10.6 liters) having an inner diameter of 106.3 mm and a length of 1200 mm. A sampling tube 2*a* for sucking water separated at a position of 350 mm from the top of the iron pipe was mounted from the top of the iron pipe, a sampling tube 2*b* for withdrawing a separated oil was mounted at the bottom of the iron pipe, and a sampling tube 2*c* for sampling a tar in a middle layer portion was mounted in the central portion of the iron pipe. A valve 2*d* was provided in each of the sampling tubes 2*a*, 2*b*, and 2*c*. Further, a sample tank 2*e* was mounted on the sampling tube 2*a*, and a sample tank 2*f* was mounted on the sampling tube 2*b*. Furthermore, an agitator 2*c* driven by a motor M was mounted within the pipe of the pressure vessel 1.

The pipe portion of the pressure vessel 1 was placed in a thermostatic chamber (not shown) having a control temperature width ±1° C., and oil-water separation was carried out so that the temperature profile within the sample during oil-water separation became homogeneous as soon as possible. In this case, the relationship between the Mg and water concentrations of the tar and the separation time was determined.

For the measurement, ORIMULSION was placed so that the interface of water and oil was 338 mm from the top of the pipe, followed by oil-water separation in the same manner as in Example 1. The experimental conditions and the results are summarized in Table 4. In the experiment, sulfuric acid was added in an amount slightly exceeding the stoichiometric amount relative to magnesium added.

TABLE 4

| RUN NO | Setting temp. (° C.) | Setting time (min) | Number of revolutions during temp. rise (rpm) | Sulfuric acid concn. (%) | Amt. of sulfuric acid added (%) | Charge of raw material (kg) | Tar in lower layer: Mg concn. of tar (ppm) | Tar in lower layer: Water concn. of tar (%) | Tar in lower layer: Removal of Mg (%) | Tar in lower layer: Dehydration (%) | Tar in middle layer: Mg concn. of tar (ppm) | Tar in middle layer: Water concn. of tar (%) |
|---|---|---|---|---|---|---|---|---|---|---|---|---|
| | | | ORIMULSION as raw material | | | | 110 | 29.0 | | | | |
| 1 | 200 | 60.0 | 60 | 5 | 0.0444 | 8.96 | 6 | 1.8 | 96.1 | 95.6 | 7 | 1.9 |
| 2 | 200 | 30.0 | 60 | 5 | 0.0444 | 8.98 | 7 | 2.1 | 95.4 | 94.9 | 10 | 3.0 |
| 3 | 200 | 20.0 | 60 | 5 | 0.0444 | 9.01 | 13 | 4.0 | 91.3 | 90.2 | 34 | 9.1 |
| 4 | 200 | 10.0 | 60 | 5 | 0.0444 | 8.97 | 9 | 3.7 | 94.0 | 90.9 | 61 | 18.9 |
| 5 | 180 | 60.0 | 60 | 5 | 0.0444 | 9.02 | 21 | 4.5 | 85.8 | 89.0 | 34 | 9.4 |
| 6 | 180 | 30.0 | 60 | 5 | 0.0444 | 9.01 | 22 | 5.1 | 85.1 | 87.5 | 42 | 11.3 |
| 7 | 170 | 30.0 | 60 | 5 | 0.0444 | 8.99 | 86 | 17.8 | 34.6 | 56.4 | 93 | 28.9 |
| 8 | 200 | 60.0 | 160 | 5 | 0.0444 | 8.95 | 16 | 2.6 | 89.4 | 93.6 | 44 | 5.8 |
| 9 | 200 | 30.0 | 160 | 5 | 0.0444 | 8.96 | 18 | 4.2 | 87.9 | 89.7 | 110 | 28.9 |
| 10 | 200 | 30.0 | 160 | 97 | 0.0444 | 8.98 | 16 | 3.1 | 89.4 | 92.4 | 116 | 31.9 |

Figure 8:
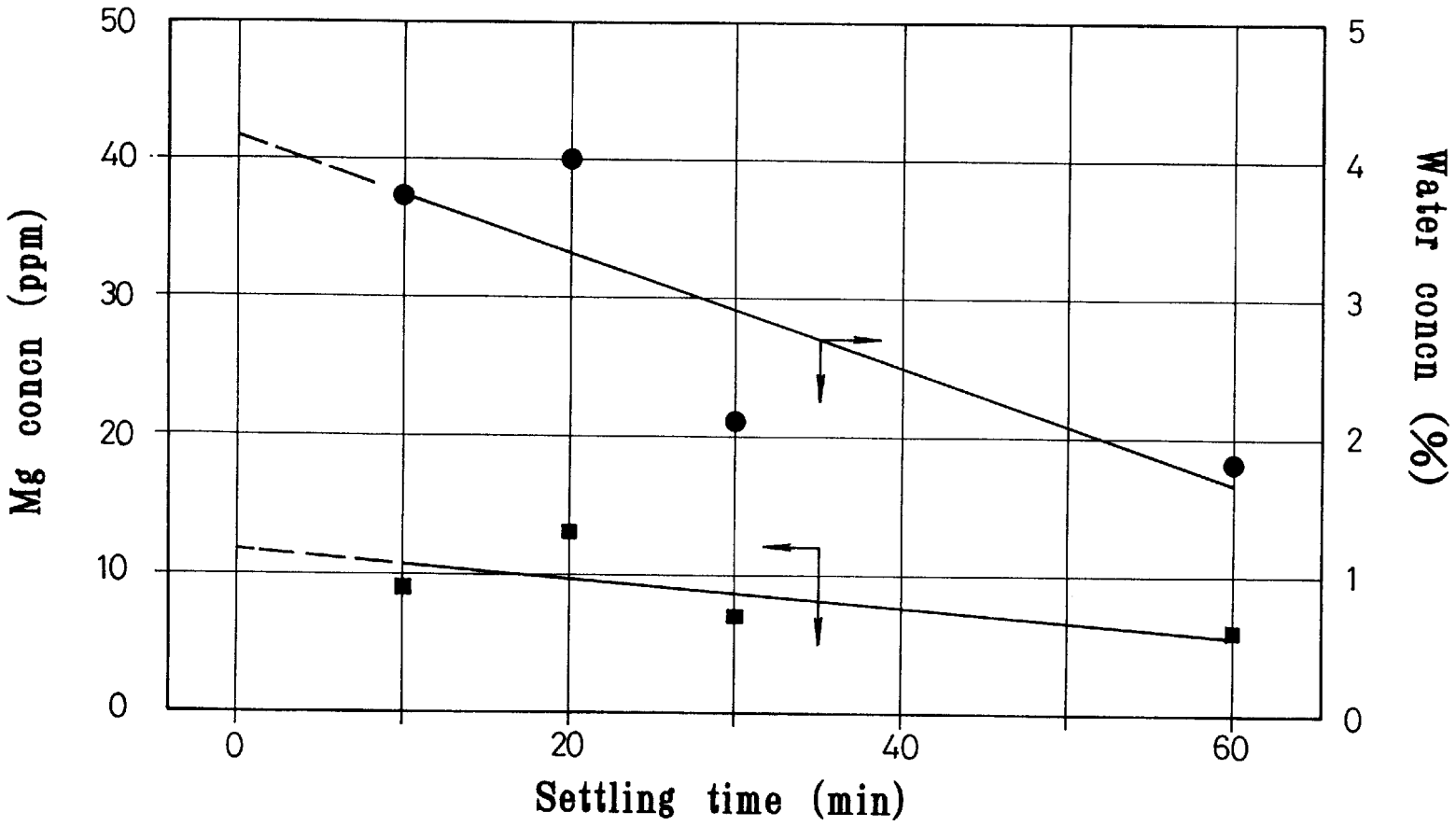
FIG. 8 is a graph showing the relationship between the standing time and the concentrations of Mg and water remaining in the reformed tarry material, based on the results of Example 2.

The measuring conditions and the results are summerized in Table 4, and the relationship between the settling time and the Mg and water concentrations of tar is shown in FIG. 8. From the results, it is apparent that when the temperature profile is satisfactorily homogeneous and there is no significant convection, standing for 10 min can offer a percentage separation of not less than 90%.

EXAMPLE 4

Example 4 of the present invention which was carried out on a commercial scale will be described.

Figure 9:
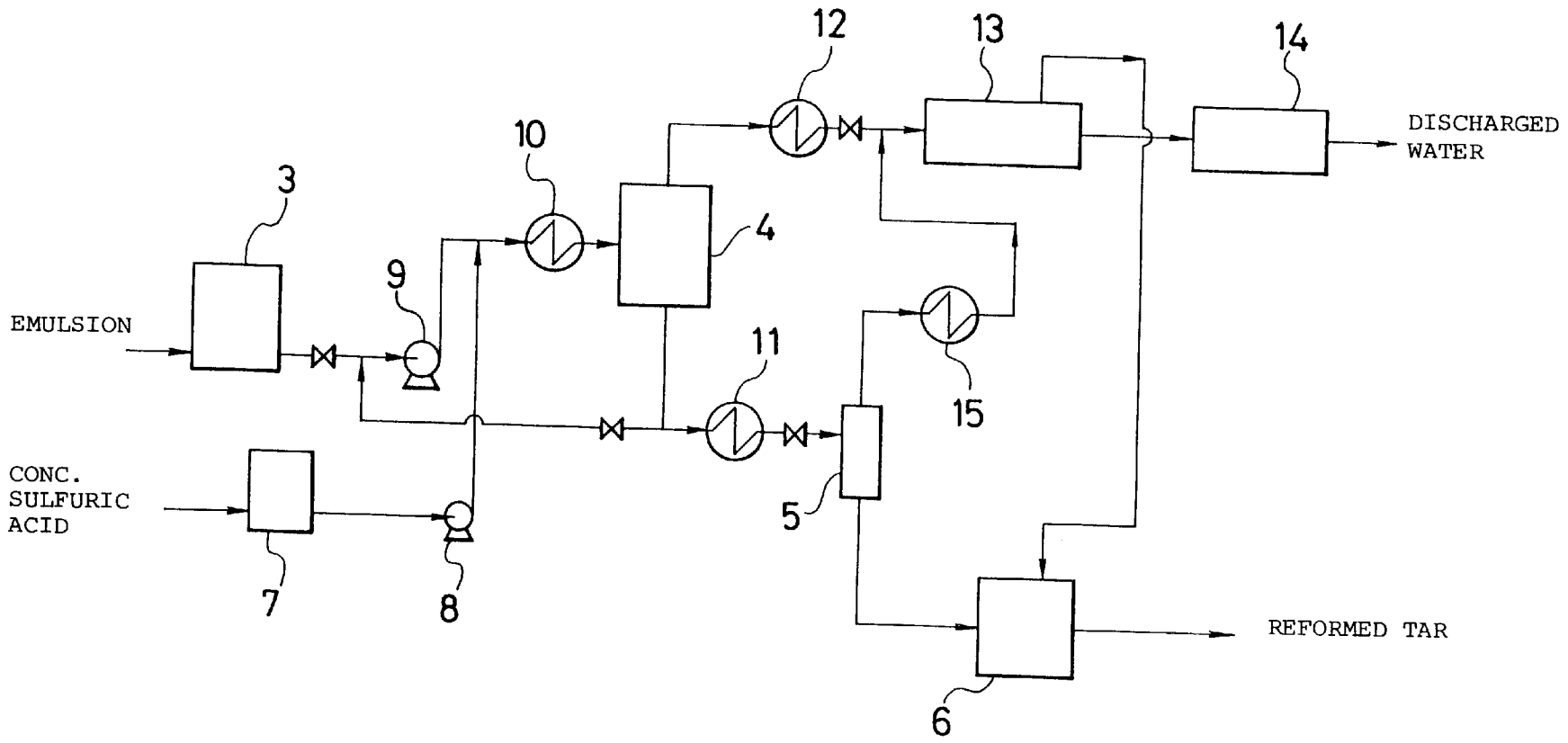
FIG. 9 is a flow diagram illustrating a continuous treatment according to the third embodiment of the present invention.

A thermal reforming apparatus shown in FIG. 9 is a continuous thermal reforming apparatus for supplying a tarry material into a diesel engine for power generation (not shown), and an emulsion storage tank 3, a thermal reforming column 4, a flash column 5, and a tar storage tank 6 constitute major equipment.

The emulsion contained in the storage tank 3 is pumped through a feed pump 9, heated by means of a heater 10 to a predetermined temperature and fed into a thermal reforming column 4. A predetermined amount of concentrated sulfuric acid contained in a concentrated sulfuric acid tank 7 is introduced by means of a feed pump a into an inlet of the heater 10, and they are mixed together in the heater 10.

The thermal reforming column 4 is a cylindrical pressure vessel which has been installed vertically or horizontally. The emulsion is fed into the cylindrical vessel in its predetermined position. The emulsion is then slowly moved through the column 4 so that standing conditions are met. In the column, oil-water separation occurs, and, at the same time, an alkali metal or an alkaline earth metal is reacted with sulfuric acid in the water phase to form a relatively heat-stable salt of sulfuric acid which is dissolved or highly dispersed in the water phase. The reformed tar is recovered from the bottom of the column, while the aqueous solution of a salt of sulfuric acid is recovered from the top of the column.

As described above, the recovered reformed tar contains a very small amount of water. After the pressure is reduced by means of a pressure-reducing valve, the formed tar is injected into a flash column 5 to evaporate a very small amount of water present in the reformed tar. The dehydrated reformed tar is recovered through the bottom of the flash column 5 and transferred to a centrifuge (not shown) attached to a diesel engine through a tar storage tank 6.

The water vapor recovered from the top of the flash column 5 entrains a light oil component contained in the tar. The mixed vapor is condensed by means of a condenser 15 and transferred as a liquid to an oil-water separator 13.

On the other hand, the aqueous solution of a salt of sulfuric acid recovered from the top of the thermal reforming column 4 is cooled by means of a condenser 12 and, after reduction in pressure, is subjected to separation of an entrained oil in an oil-water separator 13 and transferred to a water treatment system 14.

The oil separated in the oil-water tank 13 is transferred to a tar storage tank 6.

EXAMPLE 5

Figure 10:
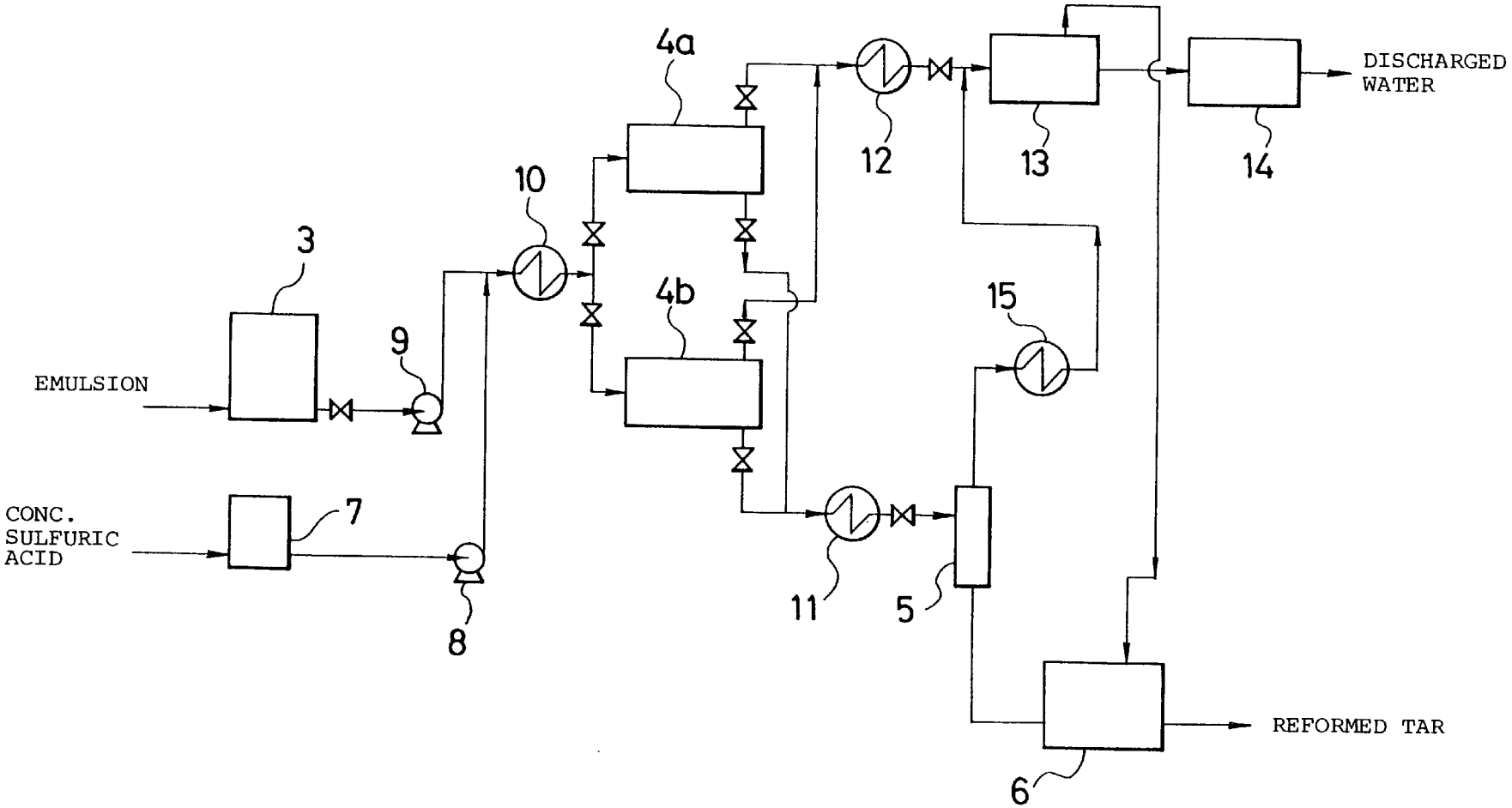
FIG. 10 is a flow diagram illustrating a batch treatment according to the fourth embodiment of the present invention.

Example 5, demonstrating the present invention on a commercial scale, shown in FIG. 10 is a batch type thermal reforming apparatus for supplying a tarry material into a diesel engine for power generation (not shown), and the major equipment and process are the same as those of the continuous thermal reforming apparatus shown in FIG. 6, except that two thermal reforming columns 4*a,* 4*b* are provided, and the operation of thermal reforming of an emulsion is carried out alternately using these columns in a batch-wise manner.

FIG. 8 shows a batch type thermal reforming apparatus applied to an emulsion wherein the formation of the aqueous solution of a salt of sulfuric acid in the upper layer is inhibited by subtle turbulence of a descending stream of tar within a continuous thermal reforming column.

What is claimed is:

1. A method for thermally reforming an oil-in-water emulsion, comprising recovering an oil component from an oil-in-water emulsion of tarry material or heavy fuel oil which contains as an impurity 400 ppm or above of vanadium and which is solid at room temperatures, the emulsion containing 100 ppm or above of a magnesium salt, said recovering of oil component comprising: adding 0.1 to 0.4% by weight sulfuric acid to the emulsion; leaving the resulting emulsion still under pressure for at least 10 minutes at a temperature of 170° to 220° C. to permit oil-water separation to take place; removing from the separated oil and water the magnesium component contained in the emulsion; and supplying an oil-phase component recovered from the tarry material or heavy fuel oil maintained in the fluidized state to apparatus for consumption thereof.

2. A method as recited in claim 1, wherein said apparatus is a diesel engine.

3. A method for thermally reforming an oil-in-water emulsion as recited in claim 1, wherein the step of removing the magnesium component further comprises removing alkali metal or alkaline earth metal contained in the tarry material or heavy fuel oil.

4. A method for thermally reforming an oil-in-water emulsion as recited in claim 2, wherein the step of removing the magnesium component further comprises removing alkali metal or alkaline earth metal contained in the tarry material or heavy fuel oil.

* * * * *